US010246790B2

(12) United States Patent
Gusev et al.

(10) Patent No.: US 10,246,790 B2
(45) Date of Patent: Apr. 2, 2019

(54) ALUMINUM ELECTROLYSIS CELL CATHODE SHUNT DESIGN

(71) Applicant: United Company RUSAL Engineering and Technology Centre LLC, g. Krasnoyarsk (RU)

(72) Inventors: Aleksandr Olegovich Gusev, g. Krasnoyarsk (RU); Aleksey Gennad'evich Burtsev, g. Krasnoyarsk (RU); Dmitriy Aleksandrovich Simakov, g. Krasnoyarsk (RU); Aleksandr Leonidovich Voynich, g. Krasnoyarsk (RU); Aleksandr Yur'evich Kolmakov, g. Krasnoyarsk (RU)

(73) Assignee: United Company Rusal Engineering and Technology Centre LLC, Krasnoyarsk (RU)

( * ) Notice: Subject to any disclaimer, the term of this patent is extended or adjusted under 35 U.S.C. 154(b) by 262 days.

(21) Appl. No.: 14/654,377

(22) PCT Filed: Dec. 21, 2012

(86) PCT No.: PCT/RU2012/001090

§ 371 (c)(1),
(2) Date: Jun. 19, 2015

(87) PCT Pub. No.: WO2014/098642

PCT Pub. Date: Jun. 26, 2014

(65) Prior Publication Data

US 2015/0337446 A1 Nov. 26, 2015

(51) Int. Cl.
*C25C 3/08* (2006.01)
*C25C 3/16* (2006.01)

(52) U.S. Cl.
CPC . *C25C 3/08* (2013.01); *C25C 3/16* (2013.01)

(58) Field of Classification Search
CPC .... C25C 3/06; C25C 3/08; C25C 3/16; C25C 7/00; C25C 7/02–7/025
See application file for complete search history.

(56) References Cited

U.S. PATENT DOCUMENTS 3,470,083 A 9/1969 Wrigge et al.
3,607,685 A 9/1971 Johnson
(Continued)

FOREIGN PATENT DOCUMENTS

RU 2067133 9/1996
RU 2281986 8/2006

OTHER PUBLICATIONS

International Search Report dated Sep. 5, 2013 in PCT/RU2012/001090.

*Primary Examiner* — Alexander W Keeling
(74) *Attorney, Agent, or Firm* — Hogan Lovells US LLP

(57) ABSTRACT

The invention relates to electrowinning of aluminum from cryolite-alumina melts, and can be used in the shunt design of a cathode assembly. In an aluminum electrolysis cell, cathode vertical metal shunts, are designed such that their top part is melted aluminum, and the bottom part is solid aluminum. Shunts are located in conduits made in a hearth slab lining which has a widening in the middle part which is wider than both parts of the shunts. The widening in the shunt conduit can be filled with a composite material, i.e. titanium diboride-carbon. The shunts can be designed as a tube, and the widening in the conduit and the space inside the tube can be filled with the composite material titanium diboride-carbon. The invention makes it possible to increase the electrical efficiency due to the absence of contact assemblies, reduced current loss, and achieving an effective current distribution and current shunting.

7 Claims, 3 Drawing Sheets

(56) References Cited

U.S. PATENT DOCUMENTS

| | | | | |
|---|---|---|---|---|
| 3,723,287 | A * | 3/1973 | Elliot | C25C 3/08 204/245 |
| 4,737,253 | A * | 4/1988 | Gesing | C25C 3/16 204/247 |
| 2013/0075669 | A1 * | 3/2013 | Landwehr | H01B 1/122 252/504 |

* cited by examiner

ALUMINUM ELECTROLYSIS CELL CATHODE SHUNT DESIGN

This application is a U.S. National Phase under 35 U.S.C. § 371 of International Application PCT/RU2012/001090, filed on Dec. 21, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The invention pertains to nonferrous metallurgy, in particular, the electrolytic production of aluminum from cryolite-alumina melts, and it can be used in the design of the shunts of the cathode assembly.

The cathode assembly of an electrolysis cell for the production of aluminum is an extremely important electromechanical element, largely dictating the service life of the electrolysis cell and the efficiency of the technological electrolysis process, including the current distribution in the hearth slab and the current transmission.

The existing designs of the electrical cathode assembly and the technology of its fabrication have major drawbacks. The current load is transmitted from the metal at the cathode (molten aluminum) through the carbonaceous hearth slab to steel shunt rods or blooms which are mechanically fastened (electrically conductive pastes, cast iron pouring) in carbonaceous blocks, then across the contact assembly of the steel bloom and the aluminum cathode discharge and further onto the aluminum cathode collecting busbar. Different materials are used in the electrical contact assemblies with different electromechanical properties, which causes voltage gradients in the contact assemblies, local overheating, disruption of the integrity of the contact assemblies, disruption of the integrity of the hearth slab, and consequently leads to disruptions in the current distribution in the hearth slab and destabilization of the technological process parameters.

There is a known cathode of an aluminum electrolysis cell with shunts in the form of rods which are situated in vertical tubes of material resistant to the chemical action of molten aluminum and cryolite (such as dense graphite material), and which in turn are placed inside steel pipes and separated from each other by a thermal insulating layer. The upper part of the shunt rods is in the molten condition and makes direct contact with the metal of the electrolysis cell, while the bottom part in the solid state is connected to the shunt busbars (U.S. Pat. No. 3,723,287, C22d3/02, 3/12 published 27 Mar. 1973).

The main drawbacks of this shunt design is the difficult fabrication, the bulkiness, and accordingly the substantial cost price of the cathode assembly.

The closest to the proposed invention is a shunt design for an electrolysis cell for the production of aluminum from a mixture of melted salts and alumina, including anodes, and cathode shunt elements made from aluminum and extending vertically through the bottom lining, being liquid in the upper part in contact with the cathode aluminum melt, and solid in the lower part in contact with the cathode bulbar, in which the cathode shunting elements are at least partly made in the form of an inverted truncated cone with ratio of lower cross section area to upper area of 1:2 and installed in a number equal to or greater than the number of anodes, while the bottom lining is made of refractory noncarbon material and coated with a layer of material not interacting with aluminum (RF patent No. 2281986, C25C3/08, 2006).

By its purpose, its technical nature, and the presence of similar features, this solution is chosen as the closest prior art. The known solution can eliminate the voltage gradients in the contact assemblies of the cathode shunt by eliminating these very assemblies, eliminating horizontal currents in the cathode, and accordingly lessening the circulation and wave formation at the boundary between metal and electrolyte, which directly impacts the current output and electricity consumption parameters; it reduces the filtration of melt through the hearth slab and at the boundaries between the cathode shunt element and the lining, reduces penetration of alkaline metals into the hearth slab, and thereby increases the service life of the electrolysis cell.

The main drawback of the known technical solution is that a layer of electrolyte which squeezes out the aluminum appears during the operation of the electrolysis cell between the internal surface of the pipe and the aluminum core. The electrolyte at temperatures of 600-650° C. will crystallize on the walls of the pipe and result in reduced cross section of the shunts. This leads to worsening of the electrical contact between its liquid and solid parts, an increased voltage gradient in the cathode, local heating of the shunts, destabilization of the temperature state, and disruptions in the technological operation of the electrolysis cell with a decrease in the technical and economic parameters of the process.

Moreover, when the shunt elements are made in the form of an inverted cone with ratio of the upper cross section area to lower of 1:2 and in a number equal to or greater than the number of anodes, the area of the lower cross section is determined by the allowable current density for aluminum of 0.65 A/mm. Which means that, for a conventional electrolysis cell designed for current strength of 120 kA with 16 anodes and 16 shunt elements, the dimensions of the latter become ø 120 mm in the lower and ø 170 mm in the upper part, respectively. The proposed solution with shunts has advantages in the form of a low voltage gradient in the cathode as well as serious drawbacks in the form of a significant removal of heat from the aluminum by the shunting elements, which needs to be replenished by increasing the gap between the electrodes. This increases the consumption of electricity needed to produce a ton of electrolytic aluminum.

The problem to be solved by the proposed technical solution is to ensure a reliable electrical contact in the shunt between its liquid and solid parts, and to ensure its stable state over the course of the entire operating life of the electrolysis cell. A second problem being solved by the present invention involves stabilization of the technological conditions and boosting the technical and economic parameters of the electrolysis process.

The technical results are the creation of a reliable electrical contact in the shunt between its liquid and solid parts, the assurance of a stable state over the course of the operating life of the electrolysis cell, and the stabilization of the technological conditions and boosting the technical and economic parameters of the electrolysis process.

The solution of the stated problem is achieved according to the present invention in that, in an aluminum electrolysis cell where vertical metallic cathode shunts carrying electric current from the aluminum melt to the cathode bus structure, being designed such that their upper part is molten aluminum and the lower part is solid, and placed in conduits made in the hearth slab lining, the shunt conduits have a widening in the middle part which is wider than both parts of the shunts.

The invention is supplemented by particular distinguishing features helpful in the solving of the stated problem.

According to claim 2, the widening in the shunt conduit is filled with the composite material titanium diboride/carbon.

According to claim 3, the shunts are in the form of a tube, and the widening in the conduit and the space inside the tube are filled with the composite material titanium diboride/carbon.

The essence of the invention is explained by the graphic material.

Figure 1:
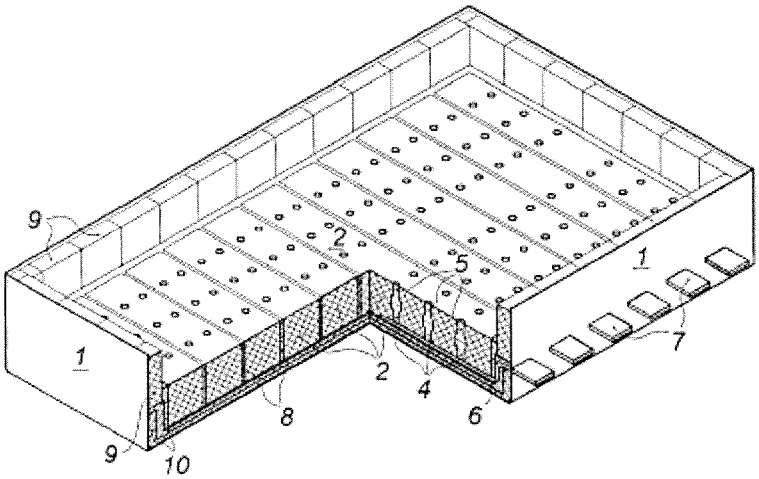
FIG. 1 shows the cathode of an aluminum electrolysis cell with the proposed shunts, shown with a quarter cut-away.
Figure 2:
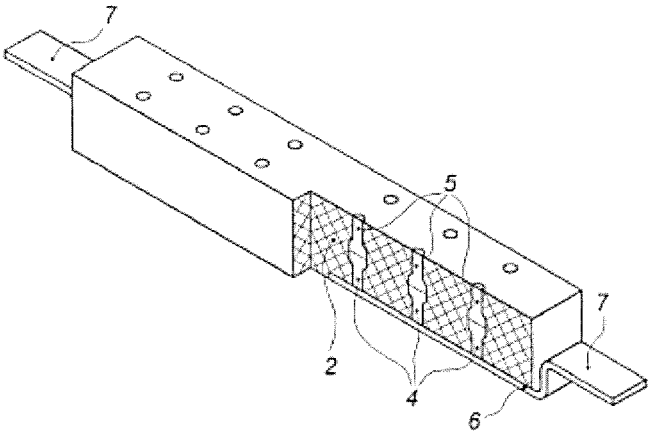
FIG. 2 shows a bottom block with conduits for the shunts.
Figure 3:
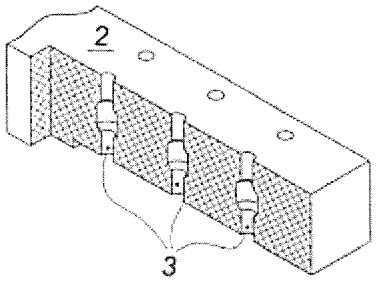
FIG. 3 shows a bottom block in assembled form with the shunts, with a cut-away view.
Figure 4:
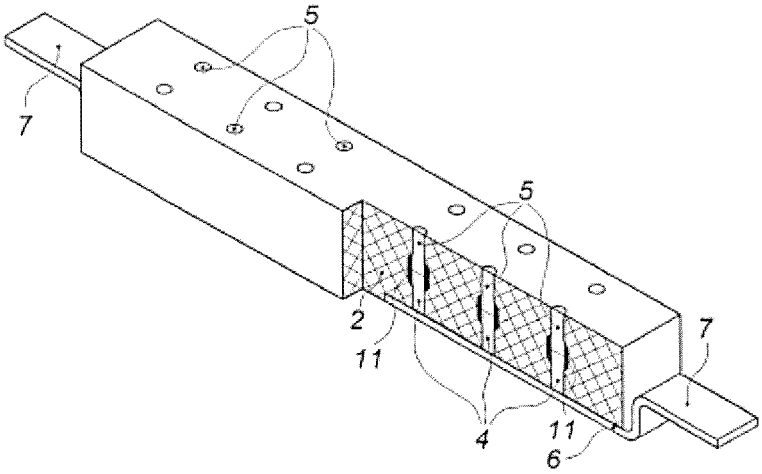
FIG. 4 shows a bottom block in assembled form with the shunts according to claim 2.
Figure 5:
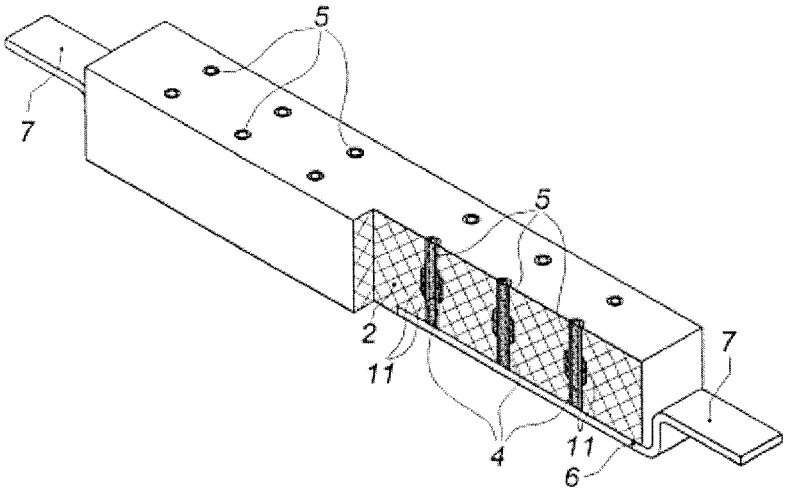
FIG. 5 shows a bottom block in assembled form with the shunts according to claim 3.

The cathode assembly of an aluminum electrolysis cell with inert anodes includes a steel cathode casing 1; bottom blocks 2 made of high-alumina concrete ($Al_2O_3$ at least 90%); aluminum shunts installed in conduits 3 of the bottom block 2, with a solid 4 and a liquid 5 part; a current-carrying collector 6 made from an aluminum plate with a part 7 extending to the outside; seams 8 between the blocks, made of high-alumina concrete; edge blocks 9; layers of refractory, for example, made from fire clay, high-alumina magnesia periclase-carbonaceous brick, and thermal insulating materials 10, which can be made from lightweight fire clay, vermiculite, foam diatomite, calcium silicate; and a composite 11 based on titanium diboride/carbon to fill the conduits 3 of the bottom block 2.

The bottom blocks 2 of the cathode assembly have conduits 3 for the shunts with solid 4 and liquid parts 5, uniformly distributed over the working surface of the bottom block 2. The conduits 3 can be made by machining of the blocks or during the forming of the bottom blocks 2. First of all, a connection is made between the solid parts 4 of the shunts and the current-carrying collector 6, made of aluminum. The connection is made by welding. Next, the current-carrying collector 6 assembled as a whole unit with the shunts is installed in the bottom block 2 and secured there by "tacking" the installation rods to the shunts projecting from the bottom block. After this, the assembled bottom block 2 is mounted in the cathode. It should be noted that supplemental preparatory steps for the fabrication of the cathode shunting conduits and the shunts and the costs of these steps are negligibly small in relation to the results achieved during the operation of the electrolysis cell.

The electrolysis cell works as follows. The cathode of the electrolysis cell prior to being started is heated to temperatures of 850-900° C. by means of gas or liquid burners or electric heaters. The upper part of the shunts is melted and becomes the liquid part of the shunt 5, and the widening in the conduit 3 (the forming cavity) becomes filled. The further draining of aluminum from the conduit 3 is prevented by the removal of heat accomplished by the collector 6, which causes the liquid aluminum to crystallize around the shunt and thereby fill the cavity existing between the conduits 3 and shunts.

After the warm-up of the cathode of the electrolysis cell, liquid aluminum is poured into the vat to create a layer of 120-150 mm on the hearth slab; this layer of aluminum joins as a single whole with the liquid part 5 of the shunts and forms a closed electric circuit. The resulting circuit effectively transmits the current load from the anodes to the cathode, with subsequent applying of the current load to the next electrolysis cell in the current path of the electrolysis bank. The transmission efficiency of the current load is dictated by the use of liquid and solid aluminum as conductors, the absence of electrical contacts of heterogeneous metals in the circuit, and the absence of electrical resistance in the material of the hearth lining.

Making the conduit 3 with a widening will substantially increase the contact area of the liquid 5 and solid parts 4 of the shunt and ensure its stable electrical contact over the course of the entire operating life of the electrolysis cell.

Moreover, the widening in the conduit 3 of the bottom block 2 can be filled with composite material 11 based on titanium diboride-carbon. This solution works as follows. The composite material 11 becomes wetted with liquid aluminum and prevents the penetration of electrolyte between the liquid 5 and solid 4 parts of the shunt. Over time, the composite material 11 itself having a porosity on the order of 30-40% becomes impregnated with aluminum and forms internal pores, capillaries, channels, and cavities filled with metal of the same composition as is being deposited at the cathode. The use of such a solution can lower the risk of aluminum leakage into the base of the vat during startup, since the cavity in the conduit of the bottom block is initially filled with the composite material, preventing the penetration of aluminum.

Furthermore, the shunt can be made in the form of a tube, the internal cavity of which is filled with the composite material 11, which in the space of a short time is entirely impregnated by liquid aluminum.

One of the benefits of this solution is a lowering of the costs of fabrication of the shunts, since the upper part of the shunt will be more or less molten, so it is perfectly logical to use a hollow tube of aluminum instead of a solid aluminum rod. This will enable a savings on the order 25-30% in the fabrication of the shunts.

Thus, there is a stabilization of the electrical and technological parameters of the electrolysis cell, an effective current distribution, a more reliable operation of the metallic cathode shunts (i.e., electrical contact in the shunt between its liquid and solid parts) and longer operating life for them, a longer service life for the electrolysis cell, and consequently better technical and economic parameters of the process.

The lining of an aluminum electrolysis cell with inert anodes is assembled as follows.

First of all, the bottom blocks 2 are assembled, for which the previously connected current-carrying collector 2 provided with conduits 3 is placed in the shaped bottom block 2, the previously connected current-carrying collector 6 with shunts 4 (vertical tubes) are secured there, and then the bottom block 2 is transported to the site of installation of the lining.

After assembly and installation of the steel cathode casing 1, its bottom is lined with refractory and thermal insulating materials 11, after which the surface of the refractory layer is covered with a layer of loose material, playing the role of a leveling cushion, on which the bottom blocks are set, with a certain spacing, so as to have a gap of 30-50 mm between adjacent blocks, in order to create the seam 8 between blocks. After this, the side lining or "brim" is laid, situated along the perimeter of the cathode casing between the bottom blocks and the lower part of the walls of the cathode casing and consisting of a layer of thermal insulating material, packed against the walls of the casing, and refractory material packed against the thermal insulating material. The projecting parts of the current-carrying collectors are clad with the side lining, ensuring tightness of the "brim" while at the same time not impeding the thermal expansion of the aluminum collectors. The brim is the base for installation of the side lining 9; the installing of the edge blocks of nonmetallic refractory compounds is done in a single row along the walls of the cathode casing 1, gluing them to the walls of the casing, and lubricating all of the bearing and joining surfaces. One can use as the adhesive or cementing composition gunite, mortar, or refractory concrete containing silicon carbide powder The culminating and critical operation in the assembly of the lining is the filling of the seams 8 between the bottom blocks 2.

Use of the proposed technical solution enables a substantial boosting of the efficiency of use of electricity thanks to the absence of contact assemblies with heterogeneous materials in the cathode shunt, the lowering of the current losses, and the assurance of an effective current distribution and effective current shunting.

The invention claimed is:

1. An aluminum electrolysis cell cathode shunt and conduit system, the system comprising:

a vertical metallic cathode shunt carrying electric current from an aluminum melt to a cathode bus structure, the shunt comprising a shunt upper part consisting of molten aluminum and a solid shunt lower part, wherein the shunt upper part and the shunt lower part contact at an interface; and a shunt conduit within a hearth slab lining, wherein the shunt is within the shunt conduit, wherein the shunt conduit comprises a conduit upper part, a conduit lower part, and a conduit middle part between the conduit upper part and the conduit lower part, the conduit middle part comprising a central region surrounded radially by an annular region which is wider than both the conduit upper part and the conduit lower part, wherein the central region of the conduit middle part has a vertical cylinder shape with an outer edge, wherein the annular region of the conduit middle part surrounds the outer edge of the vertical-cylinder-shaped central region, and wherein the interface between the molten aluminum shunt upper part and solid shunt lower part is within the conduit middle part.

2. The aluminum electrolysis cell cathode shunt and conduit system according to claim 1, wherein the annular region of the conduit middle part is filled with a composite material based on titanium diboride-carbon and the shunt passes through the central region of the conduit middle part but not into the annular region.

3. The aluminum electrolysis cell cathode shunt and conduit system according to claim 1, wherein the shunt consists of aluminum.

4. An aluminum electrolysis cell cathode shunt and conduit system, the system comprising:

a vertical metallic cathode shunt carrying electric current from an aluminum melt to a cathode bus structure, the shunt consisting of a shunt upper part consisting of molten aluminum and a solid shunt lower part, wherein the shunt upper part and the shunt lower part contact at an interface; and a shunt conduit within a hearth slab lining, wherein the shunt is within the shunt conduit, wherein the shunt conduit comprises a conduit upper part, a conduit lower part, and a conduit middle part between the conduit upper part and the conduit lower part, the conduit middle part comprising central region surrounded radially by an annular region which is wider than both the conduit upper part and the conduit lower part, wherein the central region of the conduit middle part has a vertical cylinder shape with an outer edge, wherein the annular region of the conduit middle part surrounds the outer edge of the vertical-cylinder-shaped central region, and wherein the interface between the molten aluminum shunt upper part and solid shunt lower part is within the conduit middle part.

5. An aluminum electrolysis cell cathode shunt and conduit system, the system comprising:

a vertical metallic cathode shunt carrying electric current from an aluminum melt to a cathode bus structure, the shunt comprising a tube-shaped shunt upper part and a tube-shaped shunt lower part each having a cavity, the shunt upper part consisting of molten aluminum and the shunt lower part being solid, wherein the shunt upper part and shunt lower part contact at an interface, and wherein the cavity within the shunt upper part and the cavity within the shunt lower part are each filled with a composite material based on titanium diboride-carbon; and a shunt conduit within a hearth slab lining, wherein the shunt is within the shunt conduit, wherein the shunt conduit comprises a conduit upper part, a conduit lower part, and a conduit middle part between the conduit upper part and the conduit lower part, the conduit middle part comprising a central region surrounded radially by an annular region which is wider than both the conduit upper part and the conduit lower part, wherein the central region of the conduit middle part has a vertical cylinder shape with an outer edge wherein the annular region of the conduit middle part surrounds the outer edge of the vertical-cylinder-shaped central region, and wherein the interface between the molten aluminum shunt upper part and solid shunt lower part is within the conduit middle part.

6. The aluminum electrolysis cell cathode shunt and conduit system according to claim 5, wherein the annular region of the conduit middle part is filled with a composite material based on titanium diboride-carbon and the shunt passes through the central region of the conduit middle part but not into the annular region.

7. An aluminum electrolysis cell cathode shunt and conduit system, the system comprising:

a vertical metallic cathode shunt carrying electric current from an aluminum melt to a cathode bus structure, the shunt comprising a shunt upper part consisting of molten aluminum and a solid shunt lower part, wherein the shunt upper part and the shunt lower part contact at an interface; and a shunt conduit within a hearth slab lining, wherein the shunt is within the shunt conduit, wherein the shunt conduit comprises a conduit upper part, a conduit lower part, and a conduit middle part between the conduit upper part and the conduit lower part, the conduit middle part comprising central region surrounded radially by an annular region which is wider than both the conduit upper part and the conduit lower part, wherein the shunt comprises a middle region comprising the lower portion of the upper part of the shunt and the upper portion of the lower part of the shunt, wherein the middle region is wider than both the upper portion of the shunt upper part and the lower portion of the shunt lower part and corresponds to the annular region of the shunt conduit, whereby the middle region carries electric current from the aluminum melt to the cathode bus structure across a larger cross-sectional area for transmission of electric current than the cross-sectional areas of the upper portion of the shunt upper part or the lower portion of the shunt lower part.

* * * * *